US005852294A

United States Patent [19]

Gulcicek et al.

[11] Patent Number: 5,852,294

[45] Date of Patent: Dec. 22, 1998

[54] MULTIPLE ROD CONSTRUCTION FOR ION GUIDES AND MASS SPECTROMETERS

[75] Inventors: Erol E. Gulcicek, Chesire; Craig M. Whitehouse, Branford; Allan G. Burt, East Haven; Michael A. Sansone, Hamden; Clement Catalano, Clinton, all of Conn.

[73] Assignee: Analytica of Branford, Inc., Branford, Conn.

[21] Appl. No.: 887,730

[22] Filed: Jul. 3, 1997

Related U.S. Application Data

[60] Provisional application No. 60/021,194 Jul. 3, 1996.

[51] Int. Cl. [6] ..... H01J 1/88

[52] U.S. Cl. ..... 250/292; 250/293

[58] Field of Search ..... 250/292, 293, 250/290, 396 R

[56] References Cited

U.S. PATENT DOCUMENTS 4,700,069 10/1987 Ino et al. ..... 250/292

*Primary Examiner*—Kiet T. Nguyen

*Attorney, Agent, or Firm*—Levisohn, Lerner, Berger & Langsam

[57] ABSTRACT

A miniature multipole rod assembly which can be operated as an ion guide or a mass analyzer is constructed by bonding individual rods directly to plates which are separated by ceramic insulators. The multipole rod assemblies are constructed by using a fixture which locates and orients all elements during the process or bonding the rods to the disks.

2 Claims, 7 Drawing Sheets

MULTIPLE ROD CONSTRUCTION FOR ION GUIDES AND MASS SPECTROMETERS

RELATED APPLICATIONS

The present application claims the priority of U.S. Provisional application Ser. No. 60/021,194 filed Jul. 3, 1996.

FIELD OF THE INVENTION

The invention relates generally to the construction of multipole rod assemblies used as ion guides and mass analyzers and more particularly to a mounting and a construction technique that allows precision assembly of small size multipole rod assemblies.

BACKGROUND OF THE INVENTION

Generally, four, six, eight, or more equally spaced parallel rods assembled in a circle are used as an ion guide in high efficiency capture, transmission, and/or storage of ions in a variety of mass spectrometers. In recent years, such multipole ion guides have been widely used in analytical instrumentation, especially in mass spectrometers(MS) interfaced with atmospheric pressure ionization (API) sources. In most API MS instruments, ions are generally formed from a sample substance at or near atmospheric pressure. A portion of the ions produced are transported into vacuum where they are subsequently mass analyzed. The ions are transported into vacuum in a neutral gas. The neutral gas must then be pumped away in one or more vacuum pumping stages. Multipole ion guides and electrostatic lens systems have been configured to retain and transport ions while neutral gas is pumped away. Unfortunately, loss of valuable analyte ions between the different pumping stages can be significant if the ion transport systems are not properly configured. The efficient removal of the background gas while retaining a significant portion of the analyte ions through all the pumping stages results in higher sensitivity for improved performance.

A multipole ion guide provides an efficient means to capture and transport ions while neutral gas in pumped away through the gaps between the rods. This purpose is served better if the ion guide is small and able to extend continuously through multiple pumping stages (i.e., through two or more pumping stage) and yet minimize the gas flow between the pumping stages. The miniature ion beam guide design, construction, and assembly technique of the present invention allows the enrichment of such ions with respect to the background neutral gas. Most mass spectrometers use conical interfaces with small sampling orifices to "skim" ions entrained in the neutral gas expanding into vacuum from atmospheric pressure. The small ion guide design allows the multipole rods to be inserted very close inside the cone across from the sampling orifice, thereby allowing more of the ions to be captured without distorting the alternating electric field lines.

If there are four rods per assembly, they are most often used as quadrupole mass analyzers for their ability to filter different mass-to-charge ratio ions. The ideal shape of each of these rods is hyperbolic; however, in most cases, circular cross sectioned rods are used to generate electric field lines similar to the theoretically ideal hyperbolic field lines between the rods. The electric field lines are generated by applying AC and DC voltages between the pairs of electrodes which constitute alternating rods in the assembly. If the rod assembly is to be used as an ion guide, only AC voltage is applied to the alternating rods, with adjacent rods 180 degrees out of phase from each other. This allows a wide range of mass-to-charge ratio of ions to be stable and transmitted within the ion guide. If a DC voltage is applied between the pair of electrodes in addition to the AC voltage, the multi-rod assemblies are used as a mass filter for a very narrow molecular weight band of ions by adjusting the ratio between the AC and the DC voltages. By keeping the ion guide design small, the electrical capacitance between the rods can be kept to a minimum consuming less power from the resonant driving circuitry.

The overall performance characteristics of an ion guide or a quadrupole mass analyzer is judged by its ion transmission efficiency, mass range, sensitivity, and mass resolution. To a high degree these features of merit are determined by the accuracy of the multipole rod assembly. The straightness of the rods and the tolerance build up on all three dimensions of the assembly both play an important role in the accuracy of the results produced by a mass spectrometer. And as the size of the multipole rod assemblies get smaller, it gets harder to maintain the required tolerance levels. In larger rod assemblies conventional machining, welding, brazing and soldering practices can be used to fasten the rods together to keep desired tolerances. In smaller rod assemblies however, the machining becomes prohibitively more difficult and expensive due to lack of material strength, difficulty of handling, and lack of availability of tooling. Voltage connections to the larger rod assemblies are also simpler to make with a wider variety of fastening and brazing methods available for fabrication than for smaller rod assemblies.

To maintain straightness of multipole rods in an assembly can be a challenging task when rod diameters of one millimeter and rod lengths of beyond 75 mm are being considered. Simple welding or soldering techniques can be implemented if stainless steel rods are considered. That is one of the most readily available, inexpensive, and easy to work with materials. Unfortunately, stainless steel is also easy to bend, and and it very hard to maintain straightness at the desired diameter and length combinations. To satisfy straightness, metallic materials such as molybdenum, tungsten or gold coated quartz are commonly used in the art. However, with the desired rod diameters of one mm or less, it becomes almost impossible to fasten any support brackets or connections to the rods. Machining, welding or spot welding, brazing, or soldering of these materials to, for example, stainless steel disks as support structures, would be prohibitively difficult and expensive.

Assuming one can obtain desirably straight rods, then one has to assemble them together very accurately. All of the rods must be parallel to each other from end to end. The spacing between the rods have to be equal on a circle, and the end of the rods must meet on a same plane perpendicular to the length of the rods. Once all of these requirements are met, then the complete assembly has to be aligned with the interfacing ion optic lenses and the mass analyzer.

The present invention recognizes the difficulty of realizing a compact design while avoiding the aforementioned design constraints.

OBJECTS AND BRIEF DESCRIPTIONS OF THE INVENTION

It is the principal object of this invention to provide an improved miniature multipole rod assembly for ion guides and mass spectrometers that will improve the ion capture, transmission efficiency, sensitivity, and mass resolution of a mass spectrometer system.

It is an object of this invention to provide an ion guide assembly that will extend through multiple pumping stages, keep the opening between the two pumping stages as small as possible, and also have enough distance between the rods to pump out the background gas from inside the multipole rod assembly without compromising the total number of captured ions inside.

It is a further object of the present invention to keep a good mechanical dimensional tolerance between the rods in the assembly.

It is yet a further object of this invention to have a good electrical connection to the miniature rods and also to keep the capacitance of the rods to a minimal value.

It is also a feature of the present invention that the entry end of the rods be very close to and shaped behind a conical sampling orifice to accept a maximum number of ions, and that the exit end of the rods be configured small enough to fit inside other mass analyzing devices such as a quadrupole, ion trap, and time-of-flight.

It is a further advantage of the present invention that the multipole rod assembly does not have any electrically conductive or dielectric materials that would interfere or disturb the electric field lines which are defined by the multipole rods and which act on the ions.

These and further objects, features, and advantages of the present invention will become apparent from the following description, along with the accompanying figures and drawings.

DESCRIPTION OF THE INVENTION AND THE PREFERRED EMBODIMENTS

Figure 1:
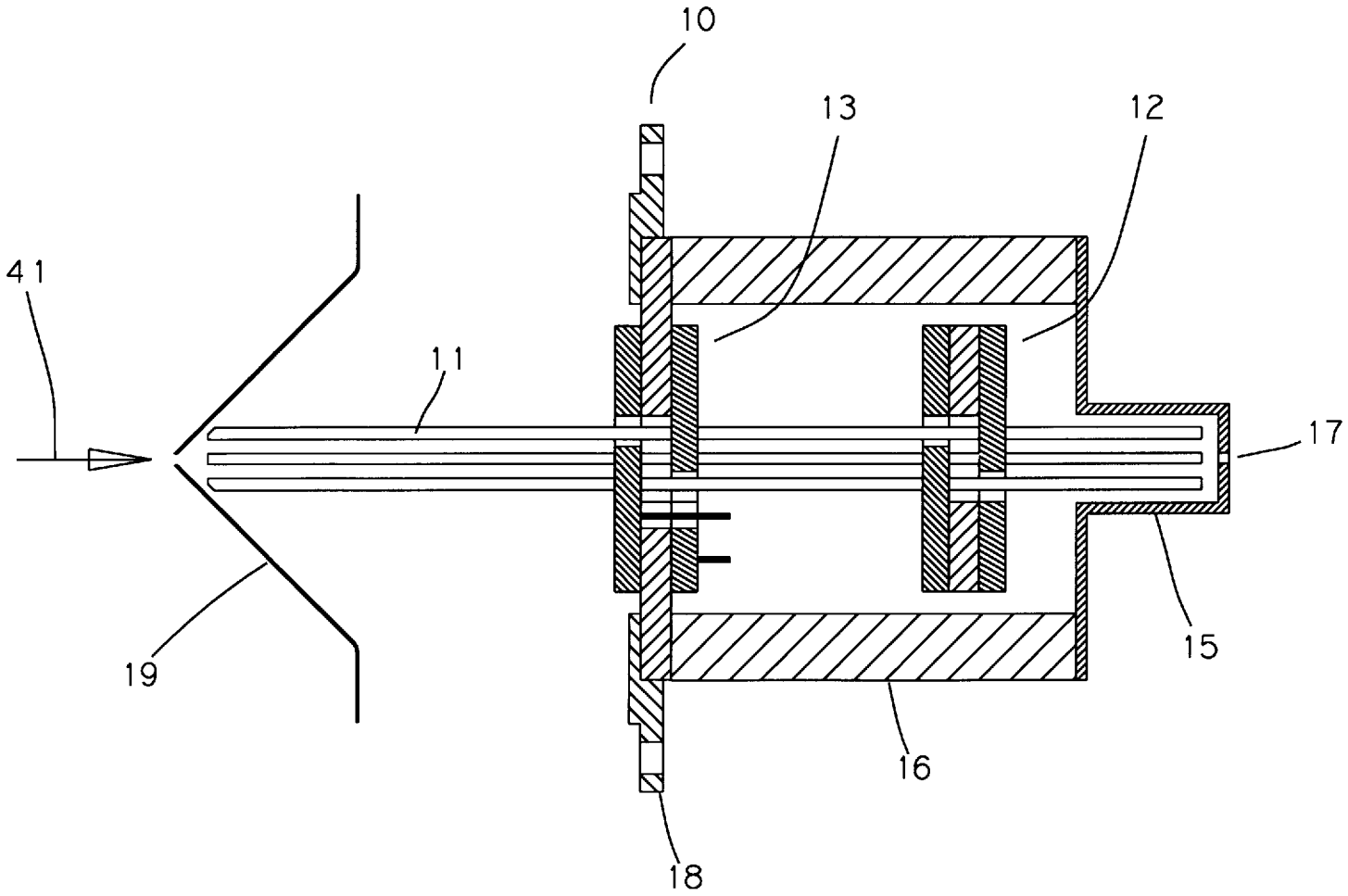
FIG. 1 is a plan view of a complete hexapole rod assembly with the sampling cone, in accordance with the present invention.

Although the number of rods used in the assembly and construction of the multipole ion guide or mass spectrometer assemblies may vary, the examples in this invention will show predominantly hexapole, meaning six, rod assembly sets. The schematic side view of the complete hexapole rod assembly 10, as shown in FIG. 1, consists of a six round, equally spaced in a circle, and parallel set of gold coated rods 11. Depending on the length, there are a minimum number of two or more attachment assemblies 12 and 13 that act as the support structure, electrical connection, and overall mounting base for other parts that may be used in conjunction with the rod assembly set. For example, the attachment assembly 13 is a mounting base for the mounting ring 18 that allows the complete assembly to be fastened to the rest of the instrument, and it is also a mounting base for an ion optical lens 15 to be mounted with spacers 16 on the ion exit side 17 of the hexapole assembly.

Figure 2:
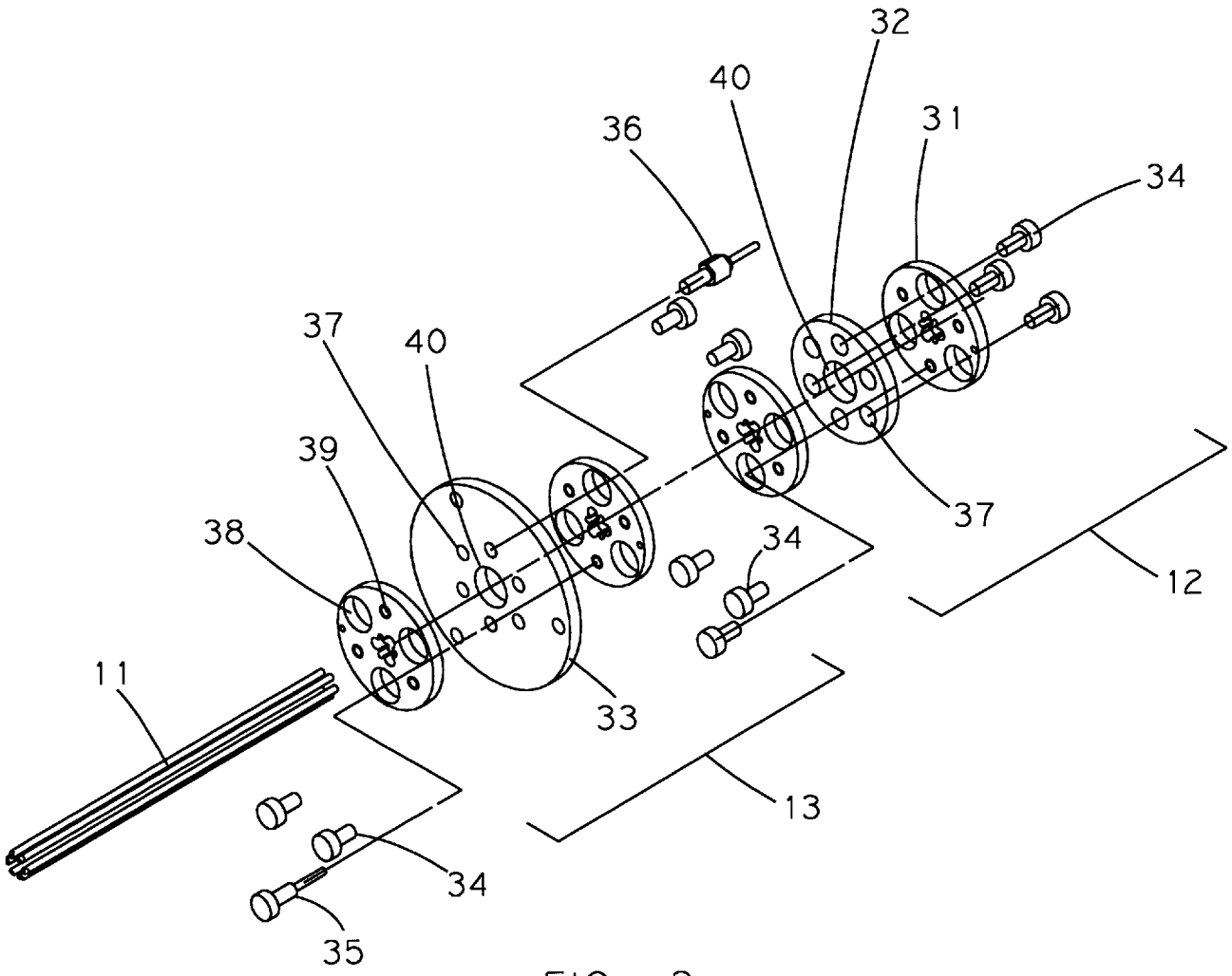
FIG. 2 is an exploded isometric view of the hexapole rod assembly before fixturing for alignment and assembly.

It is more apparent from the isometric view of the hexapole rod assembly in FIG. 2 how the rods 11 are assembled and held together by the attachment assemblies 12 and 13. Each attachment contains two identical gold coated metal discs 31, rotated 60 degrees and electrically insulated from each other on either side of the ceramic insulator discs 32 or 33. Each attachment assembly is clamped together with total of six screws 34, half of which are fastened from opposite directions. In one of the attachments, for example 13, two of the screws are replaced with connectors 35 and 36. Connectors 35 and 36 serve both as fastening screws and as pin connections that supply voltage input to all of the rods.

The head of the screws 34 always rest on the surface of the ceramic disks 32 or 33. The screws 34 clear the metal disk holes 38, i.e. the diameter of the heads of screws 34 is smaller than that of holes 38, so that when the heads do not contact the metal disk when the multipole rod construction is in operation. The screws 34 go through the holes 37 on the ceramic disks 32 or 33, and screw into the tapped holes 39 in the metal disks 31. Eventually the gold coated rods are soldered to the attachment assemblies using a fixture assembly 50 shown in FIG. 3.

As mentioned earlier, to have an accurately assembled miniature hexapole rod assembly, all six rods have to be parallel to each other from end to end. The spacing between the rods has to be equal on the circumference of a circle, and the rods must end on the same plane perpendicular to the length of the rods. Once all of these requirements are met, then the complete assembly has to be aligned with the interfacing ion optics or the mass analyzer instrument.

Figure 3:
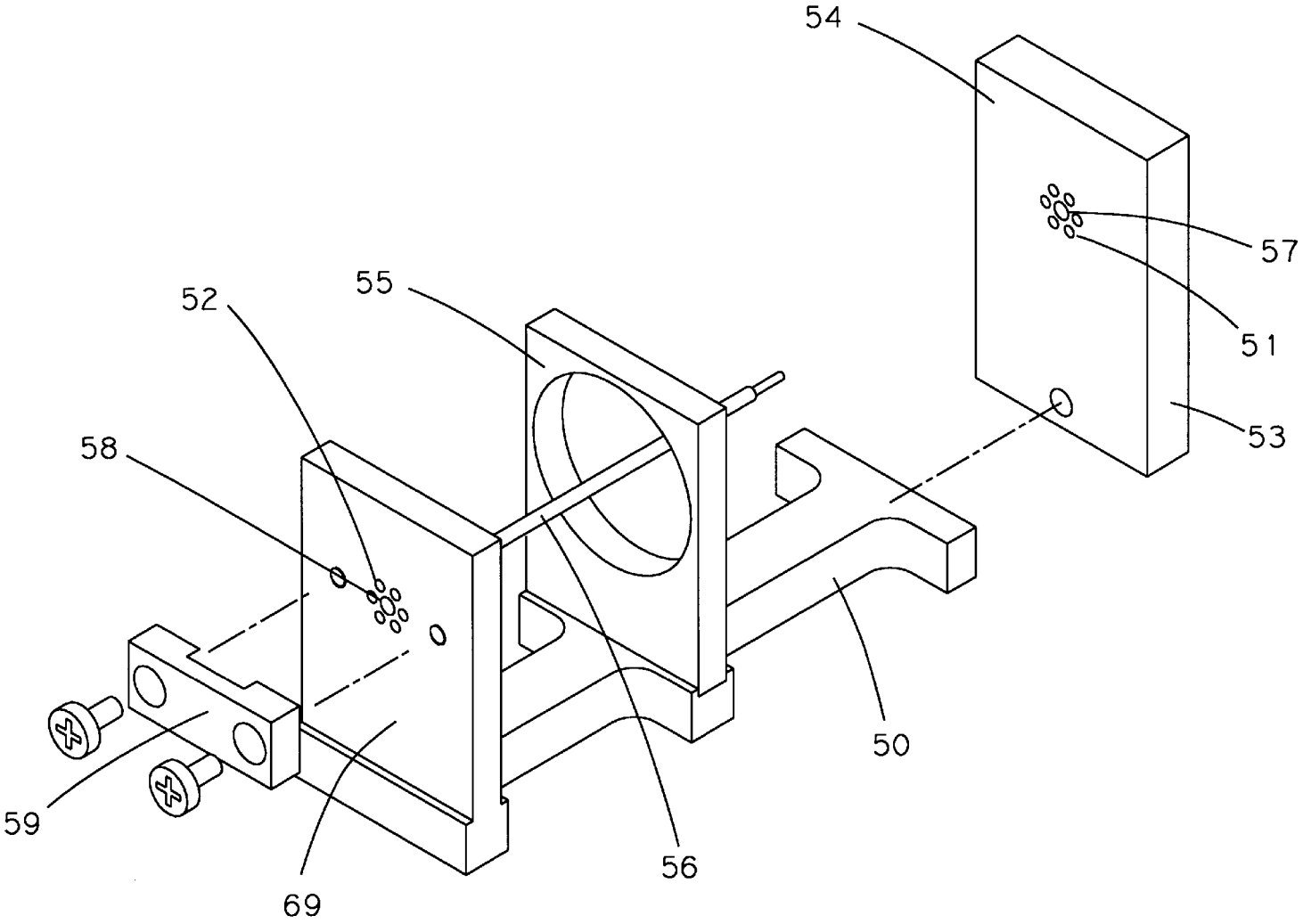
FIG. 3 is an isometric view of the fixture assembly for aligning the attachment and the hexapole rod assemblies.

These requirements are met by using a fixture assembly 50 shown in FIG. 3. The equally spaced pattern of the rod assembly is maintained by the six hole patterns 51 and 52 on both ends of the fixture 50. The alignment rod 56 rests by two holes 57 and 58 on both ends of the fixture. The alignment rod 56 allows all of the hexapole rods to be parallel to each other. As shown in the figure, this rod has a small diameter portion which fits in center hole 57, and a larger diameter portion extending down the length of the fixture assembly. The large diameter portion (which is circular in cross-section) is of a diameter such that when the multipoles are arranged in a circle and inserted into the the holes of hole patterns 51 and 52, the multipole rods all surround, touch, and rest against the alignment rod 56. This, along with the hole patterns 51 and 52, ensures during the assembly process that the multipole rods are all properly spaced and aligned.

Figure 4:
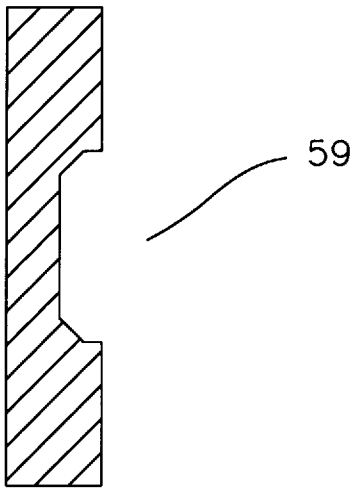
FIG. 4 is a cross sectional view of the end cap piece on the fixture assembly which is used to align the rods.

The end piece 53 of the fixture is removable so the rod assembly can be installed, soldered and be removed. When rods have different wedge geometries at the ends (e.g. tapers at the ends of the rods), their rotational alignment is fixed by the cap 59 placed at the end of the fixture assembly having a matching geometry. FIGS. 3 and 4 show cap 59. This caps 59 is particularly useful for aligning the rods that are wedged to fit behind a conical shaped sampling orifice. The cap 59 screws into fixture assembly post 69. The ends of the multipole rods are inserted through hole pattern 52 to rest against the end piece 53. By resting these ends of the equal length rods against cap 59, the ends of the other side of the rods become aligned in a plane. In other words, since the rods are machined to be of equal length, resting one end against the cap 59 ensures that the other ends of the rods are all aligned to end at a plane which is perpendicular to the rods' axes.

In addition, for additional precision, the attachment assemblies 12 and 13 are seated against the fixture surfaces 54 and 55 for accurate alignment of the complete rod assembly with respect to the rest of the instrument.

Figure 5A:
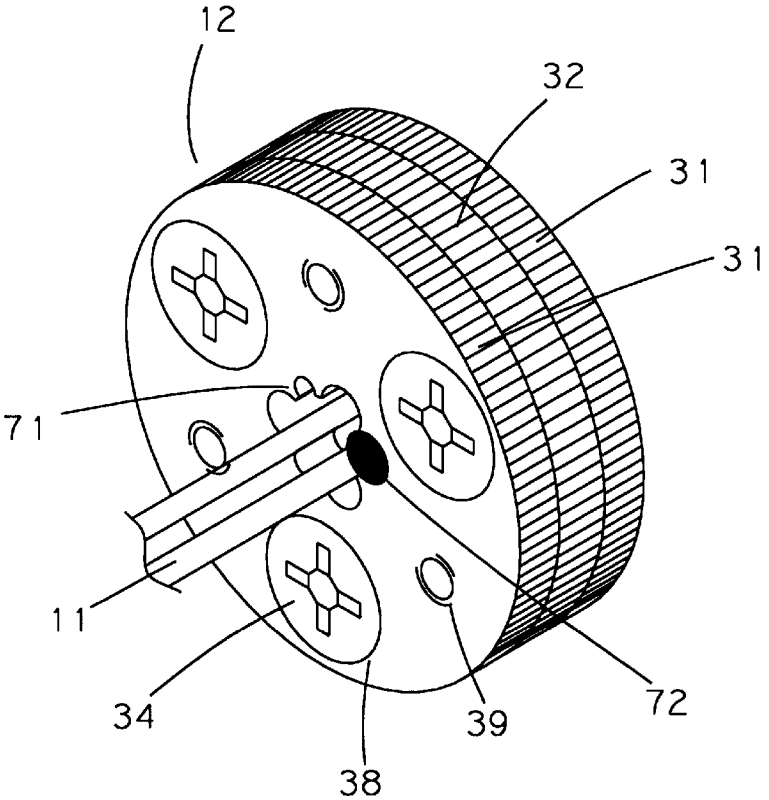
FIG. 5A is an isometric view of the soldering area showing how the hexapole rods are fastened to the disks in the attachment assemblies.
Figure 5B:
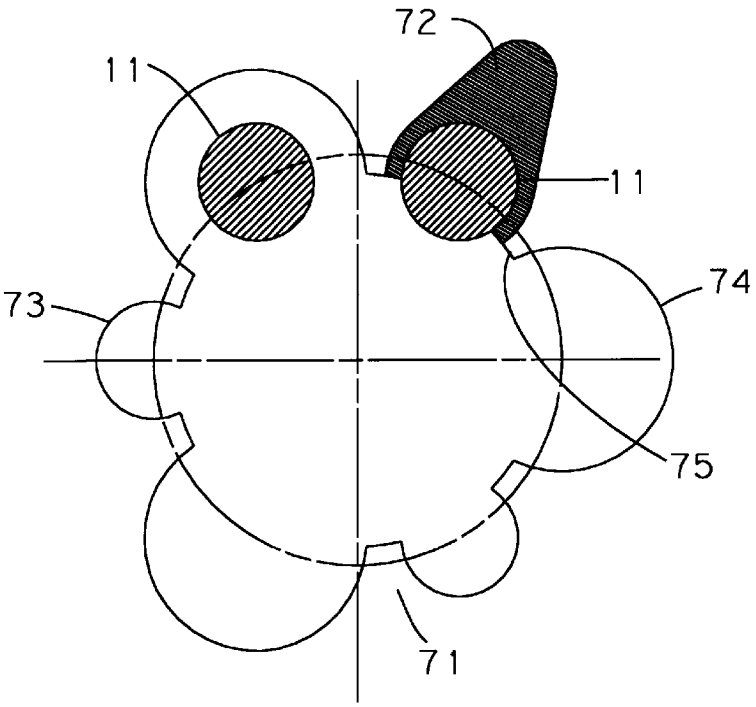
FIG. 5B is an exploded view of the soldering area of FIG. 5B.

FIG. 5A shows a detailed view of how two of the representative six rods are fastened to the attachment assemblies. The gold coated metal disks 31 each have an uneven clover shaped pattern 71 in the center as shown in FIG. 5B. After being gold coated, three of the six tungsten rods 11 (i.e. every other rod) and the smaller three of the interrupted holes 73 on the clover pattern on the metal disks get soldered to each other at joints 72. The other three alternate rods the holes 74 on the same metal disk, and get soldered to the holes 73 of the metal disk 31 on the other side of the ceramic insulator (which second metal disk is 60 degree rotated to the first metal disk). Naturally, the center hole 40 on the ceramic insulators 32 and 33 clear the rods.

On making the solder joints 72, extreme care must be taken not to overflow the materials around the rods 11 or the outer edge 75 of the interrupted hole 73 on the metal disk, for any physical perturbation inside the six rods will negatively affect the electric field, hence, the mass spectral performance. The clover shape 71, especially the amount of allowable material on the hole 73 around the rods were carefully chosen not to disturb the electric field generated by the six rod electrodes. Yet, to achieve limited gas flow between two pumping stages, the holes 73 were cut out to be as large as possible. It was found that approximately half or slightly more than half circumference interruption on the hole 73 was optimum for both minimal electric field distortion and minimal gas throughput.

In the preferred embodiment, of the many materials that can be used, to comply with the rigidity aspects of the rods, the present invention uses accurately ground 1.0 mm diameter tungsten rods that can vary in length. As mentioned earlier, many rigid metal materials such as tungsten, molybdenum, and the like cannot be directly brazed or welded on to other support materials without damaging or altering the straightness of the rods due to excessive heat. In the preferred embodiment, soldering directly is not an option since many available soldering alloys do not bind to these types of metals. Although electrically conductive or insulating epoxy is a consideration, it was experienced many times that in a small assembly setting, the flow of such epoxy materials could not be controlled to the exact needed location 72. In addition, conductive epoxy lacks the preferred material strength. Insulating epoxies do not assure a definitive electrical contact to the rods, nor can they be relied upon as materials to be so close to the path of the ions. Surface charge effects from ions on the surface of insulating materials could build large electric fields inside the rods cutting off ion transmission. Poor chemical resistance of many epoxies to commonly used solvents were also a deterrent on their use in the assembly, in the preferred embodiment. As mentioned earlier, due to the small diameter nature of the rods, mechanical fastening of the assembly parts were not considered.

Thus, in the preferred embodiment, to bind the hexapole rods 11 to the metal discs 31, all parts were first gold coated. This was done using a soldering alloy material, preferably indium, silver or lead. Strong soldering joints 72 were established between the back side of the rods and the surface of the metal disk 31 as much away from the open space between the hexapole rods as possible. The rods are soldered on the surface of the metal disks, and the solder wicks into the small diameter holes 73 to create joint 72. In FIG. 5B a view is presented from the top of the disk, with the solder being located both on top of the disk, and wicking down by capillary action into the holes 73 to surround a portion of the multipole rods.

Figure 6:
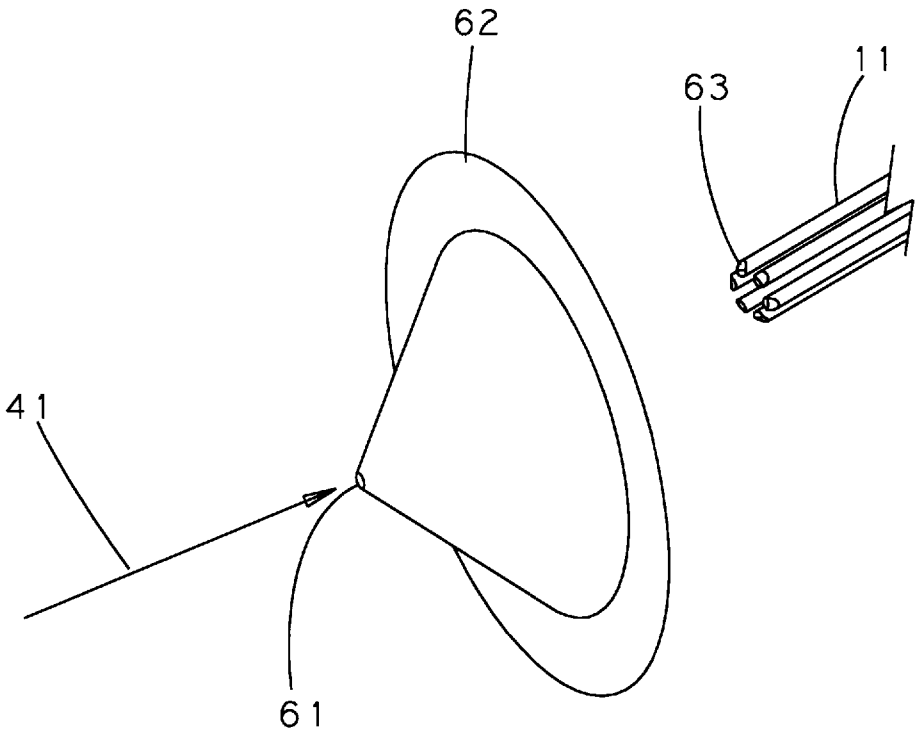
FIG. 6 is the isometric view of the entry end of the rods, shown with a possible conical sampling orifice.

The ion entry section 41 of the rod assembly 10 is shown in FIG. 6. Most common ion sampling orifices 61 used in API MS instruments are situated at the tip of conical shaped electrodes 62. To achieve a maximum number of ions entering into the ion guide from the orifice, the tip of the rods 63 are beveled parallel to the walls of the cone prior to gold coating process. This allows the rod assembly to come as close to the sampling orifice as possible, especially when the rod diameter and the overall rod-to-rod distance is small. While the ions are captured inside the rods emanating from the aperture 61, the background gas is pumped out through the space between the rods.

The overall small size of the hexapole rods also allows the exit end of the assembly to interface to other mass analyzers. For example, the small multipole rod assemblies can more effectively interface to quadrupole mass analyzers by penetrating inside the analyzer, which generally itself has larger rod diameters and rod to rod distances. FIG. 7A shows such an interface 71 where the hexapole rods 11 and the hexapole exit lens 72 penetrates inside the quadrupole rod set 73.

Figure 7B:
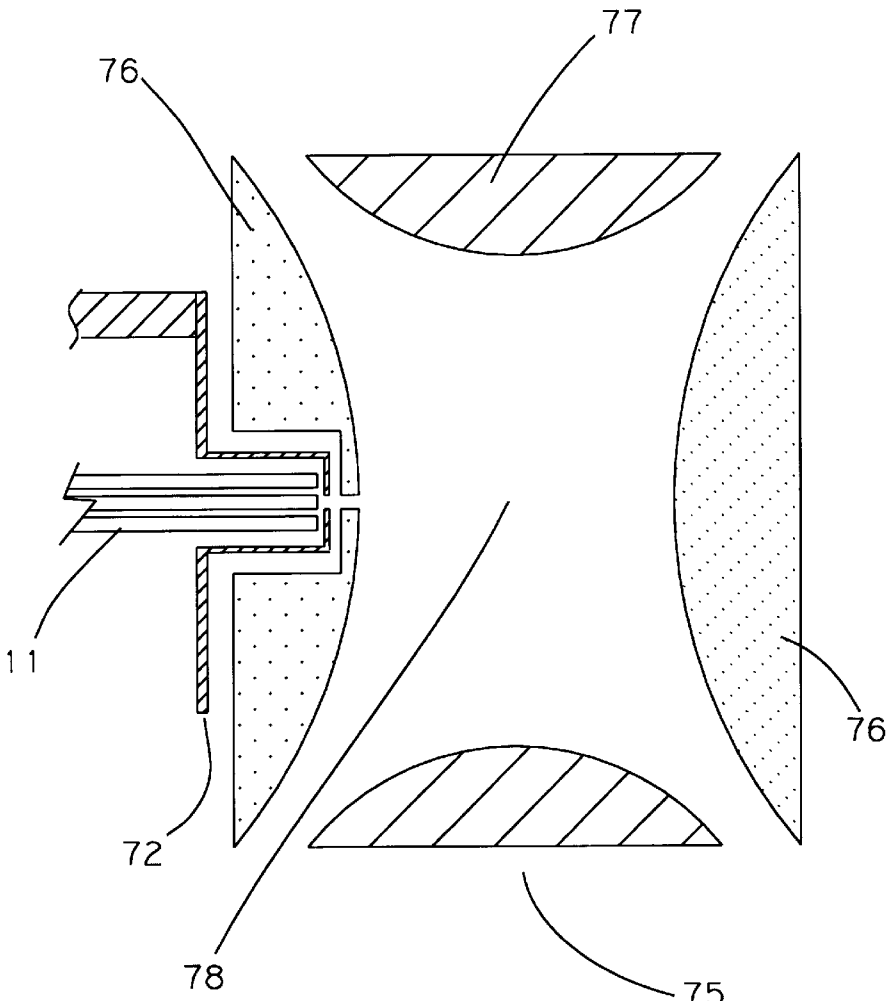
FIGS. 7A and 7B are plan views of the exit end of the ion guide with two possible mass analyzer interfaces, a quadrupole and an ion trap, respectively.
Figure 7A:
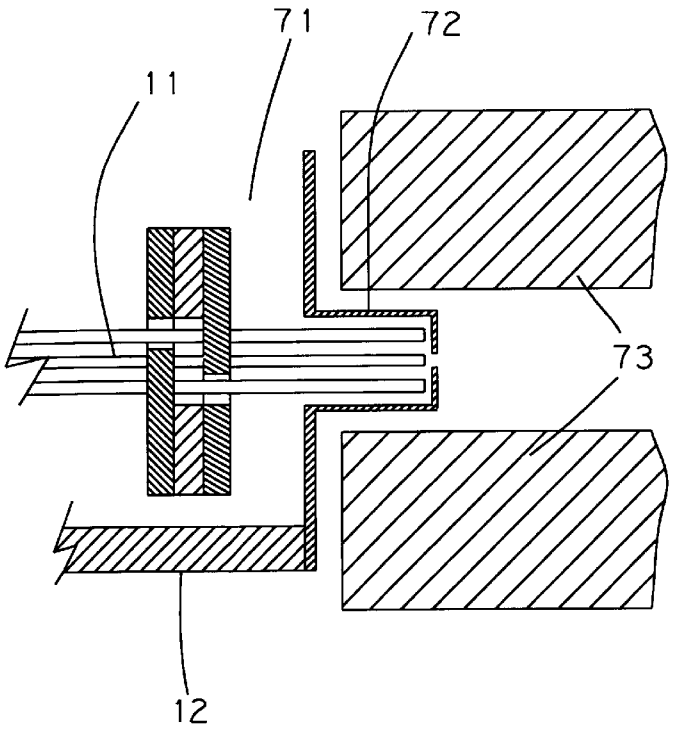

Another type of interface 75 is shown in FIG. 7B for three dimensional ion trap mass spectrometers. To come as close to an ion storage space 78 of a three dimensional ion trap as possible, the hexapole rods 11 and the hexapole exit lens 72 penetrate inside the end cap 76 of an ion trap having a ring electrode 77 and two end cap electrodes 76.

Having described this invention with regard to specific embodiments, it is to be understood that the description is not meant as a limitation since further variations or modifications may be apparent or may suggest themselves to those skilled in the art. It is intended that the present application cover such variations and modifications as fall within the claims.

References

The following references, providing background to the present invention, are incorporated herein by reference:

1. Hurst et al., U.S. Pat. No. 4,990,777, Feb. 5, 1991
2. Shunroku Taya, U.S. Pat. No. 4,870,283
3. Brubaker, U.S. Pat. No. 3,410,997
5. Smith et. al., U.S. Pat. No. 4,032,782
6. Hong Jie Xu et al., Nuclr. Intrum. and Methods in Phys. Res., Vol. 333, p. 274, 1993.
7. McGinnis, U.S. Pat. No. 3,699,330.
8. Uthe, U.S. Pat. No. 3,553,451
9. Young et. al., U.S. Pat. No. 3,350,559.

What is claimed is:

1. A multipole rod assembly for producing electric fields for directing ions, comprising:

(a) a plurality of aligned and equally spaced rigid rods, each of said rods having a diameter less than approximately 2.5 mm; and, (b) a plurality of rod attachment assemblies along said rods, said rod attachment assemblies supporting and maintaining said rods, said attachment assemblies comprising two metal discs, said two metal disks having an insulator disc between said metal disks.

2. A multipole rod assembly as claimed in claim 1, wherein said metal disks have at least one hole for enclosing at least half of the circumference of the rod passing through said hole.

* * * * *